US012024910B2

(12) United States Patent
Asiala, Jr. et al.

(10) Patent No.: US 12,024,910 B2
(45) Date of Patent: Jul. 2, 2024

(54) RETAINER CLIPS FOR TEMPORARY WALL SYSTEM

(71) Applicant: Signature Wall Solutions, Inc., Midland, MI (US)

(72) Inventors: Wiljo E. Asiala, Jr., Midland, MI (US); Kenneth Staten, Clare, MI (US); Zachary E. Cesa, Midland, MI (US)

(73) Assignee: Signature Wall Solutions, Inc., Midland, MI (US)

( * ) Notice: Subject to any disclaimer, the term of this patent is extended or adjusted under 35 U.S.C. 154(b) by 0 days.

(21) Appl. No.: 18/468,701

(22) Filed: Sep. 16, 2023

(65) Prior Publication Data

US 2024/0102301 A1 Mar. 28, 2024

Related U.S. Application Data

(60) Provisional application No. 63/409,797, filed on Sep. 25, 2022.

(51) Int. Cl.
*E04G 21/24* (2006.01)

(52) U.S. Cl.
CPC ..... *E04G 21/243* (2013.01)

(58) Field of Classification Search
CPC ..... E04G 21/243; E04B 2/08; E04B 2/721; E04B 2/74; E04B 2/7401; E04B 2/7405; E04B 2002/0243; E04B 2002/0247; E04B 2002/725; E04B 2002/726; E04B 2002/7462; E04B 2/7425; E04B 1/6187
USPC ..... 52/580, 582.1, 582.2, 584.1
See application file for complete search history.

(56) References Cited

U.S. PATENT DOCUMENTS 3,377,763 A * 4/1968 Beckman ..... E04B 5/023 52/584.1
3,640,039 A * 2/1972 McKee ..... E04B 1/6158 52/396.04
4,625,483 A * 12/1986 Zacky ..... E04B 2/7425 52/282.2
8,046,957 B2 * 11/2011 Towersey ..... E04B 2/7424 52/79.9
8,683,769 B2 * 4/2014 Cerny ..... E04F 15/02194 52/584.1

(Continued)

FOREIGN PATENT DOCUMENTS

CA 1237266 A * 5/1988 ..... E04B 2/7448
GB 2226057 A * 6/1990 ..... E04B 2/7425

(Continued)

OTHER PUBLICATIONS

KR10-2020-0000715 document and Machine Translation (Year: 2020).*

*Primary Examiner* — Ryan D Kwiecinski
(74) *Attorney, Agent, or Firm* — Harness, Dickey & Pierce, P.L.C.

(57) ABSTRACT

A clip for coupling a first wall panel comprising a first joiner and a core adjacent to the first joiner and a second wall panel comprising a second joiner includes a longitudinal wall, a vertical wall perpendicular coupled to the longitudinal wall, a recessed wall coupled to the vertical wall and a retaining wall coupled to the recessed wall extending from the recessed wall. The vertical wall, the recessed wall and said retaining wall extend into a channel formed by the second joiner. An insert wall extends from the longitudinal wall and is sized to be received outside the first channel.

19 Claims, 10 Drawing Sheets

(56) References Cited

U.S. PATENT DOCUMENTS

| | | | |
|---|---|---|---|
| 10,041,249 | B1 | 8/2018 | Hebert et al. |
| 10,329,760 | B2 | 6/2019 | Harber et al. |
| 2021/0238845 | A1 | 8/2021 | Bickford et al. |

FOREIGN PATENT DOCUMENTS

| | | | | | |
|---|---|---|---|---|---|
| GB | 2250759 | A | * | 6/1992 | ..... E04B 2/7425 |
| JP | H0632513 | U | * | 4/1994 | |
| KR | 2020000715 | A | * | 1/2020 | ..... E04B 2/7425 |

* cited by examiner

RETAINER CLIPS FOR TEMPORARY WALL SYSTEM

CROSS-REFERENCE TO RELATED APPLICATION

This application is non-provisional application of U.S. Provisional Application No. 63/409,797, filed on Sep. 25, 2022. The entire disclosure of the above application is incorporated herein by reference.

FIELD

The present disclosure relates generally to wall systems and, more particularly, to a joiner for wall systems and more particularly, to temporary wall systems.

BACKGROUND

This section provides background information related to the present disclosure which is not necessarily prior art.

Temporary wall systems have been in use for many years for various purposes. Sometimes temporary walls are constructed from studs and drywall, then destroyed when done. Temporary wall systems may be used to separate an area under construction from an area being used. The temporary wall systems separate dirt and noise associated with a construction area from the portions of the structure that are still in use. Temporary wall systems can also be used to reduce the amount of floor area heated and cooled in a larger structure, while allowing expansion when needed.

Reusable temporary walls are used in many industries to reduce waste and cost. Reusable wall systems are easily installed and disassembled so they can be moved to a different location for reuse. Reusable temporary wall systems are typically formed at standard heights such as 8 feet. Securing the walls together until intentional disassembly is important.

SUMMARY

The ability to provide a simplistic wall system that is aesthetically pleasing while providing a pressure seal to prevent dust and dirt contamination is important. Providing a simple strong hardware system that allows the wall panels to remain assembled without damage to the walls is important.

In one aspect of the disclosure, a clip for coupling a first wall panel comprising a first joiner and a core adjacent to the first joiner and a second wall panel comprising a second joiner includes a longitudinal wall, a vertical wall perpendicular coupled to the longitudinal wall, a recessed wall coupled to the vertical wall and a retaining wall coupled to the recessed wall extending from the recessed wall. The vertical wall, the recessed wall and said retaining wall extend into a channel formed by the second joiner. An insert wall extends from the longitudinal wall and is sized to be received outside the first channel.

The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
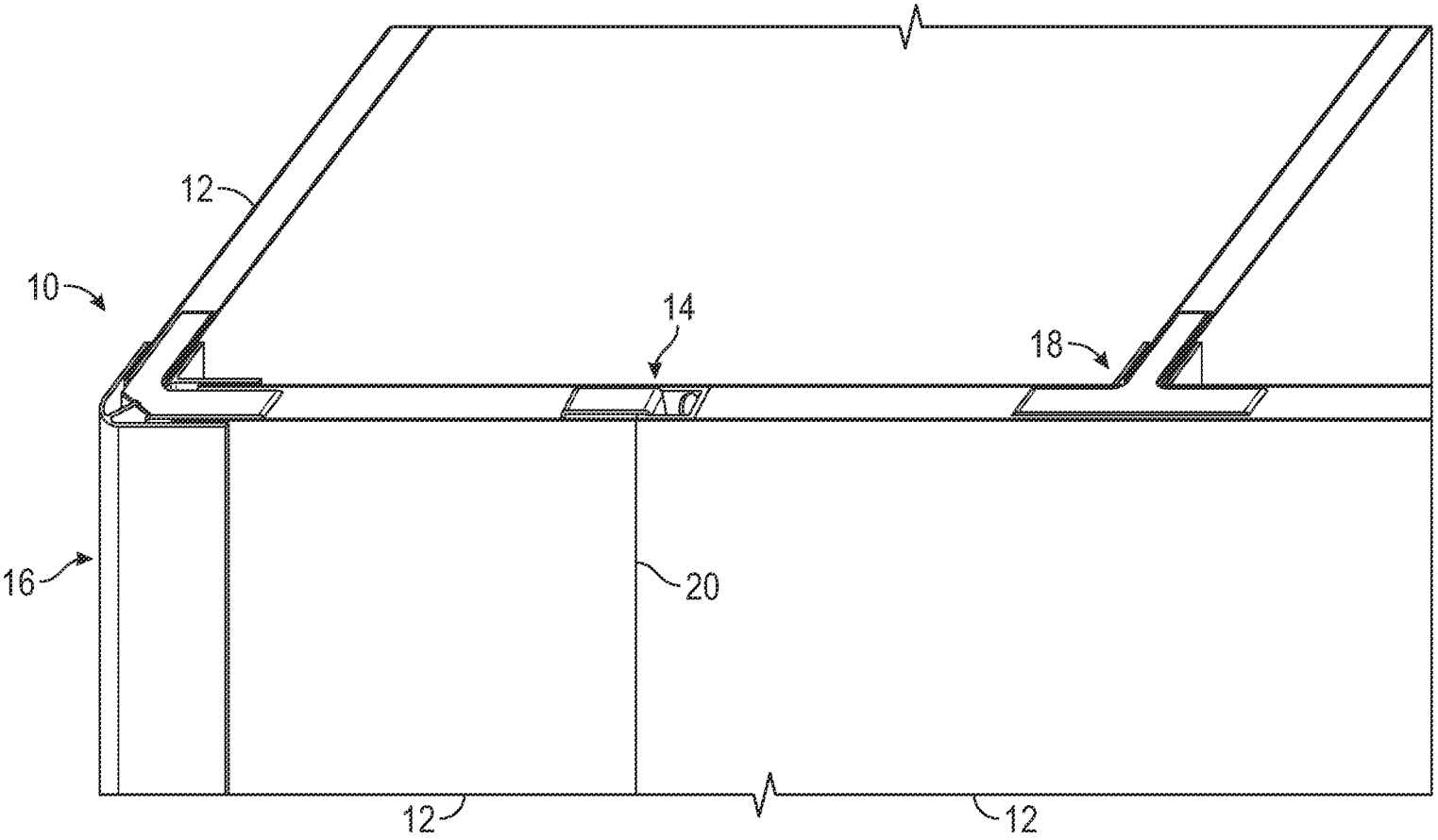
FIG. 1 is a front view of a plurality of wall panels coupled together at a seam.

Referring now to FIG. 1, a front view of wall panel system 10 a plurality of wall panels 12 coupled in various configurations is shown. One way the panels 12 are joined are in-line at an inline joint 14, in a corner at a corner joint 16 or at a T-Joint 18. The inline joint 14 forms a seam 20 that is hardly noticeable if the wall panels 12 are formed of the same outer material or skins 22. The corner joint 16 is disposed at one edge of the plurality of wall panels 12 that form a 90° angle (although other angles may be used. As will be described in greater detail below. The T-joint 18 may also extend at 90° from the in-line wall panels 12 and extend a predetermined distance. The wall panels 12 may continue in another direction. Examples of the corner joint 16 and the T-joint 18 are illustrated in greater detail below.

Figure 2:
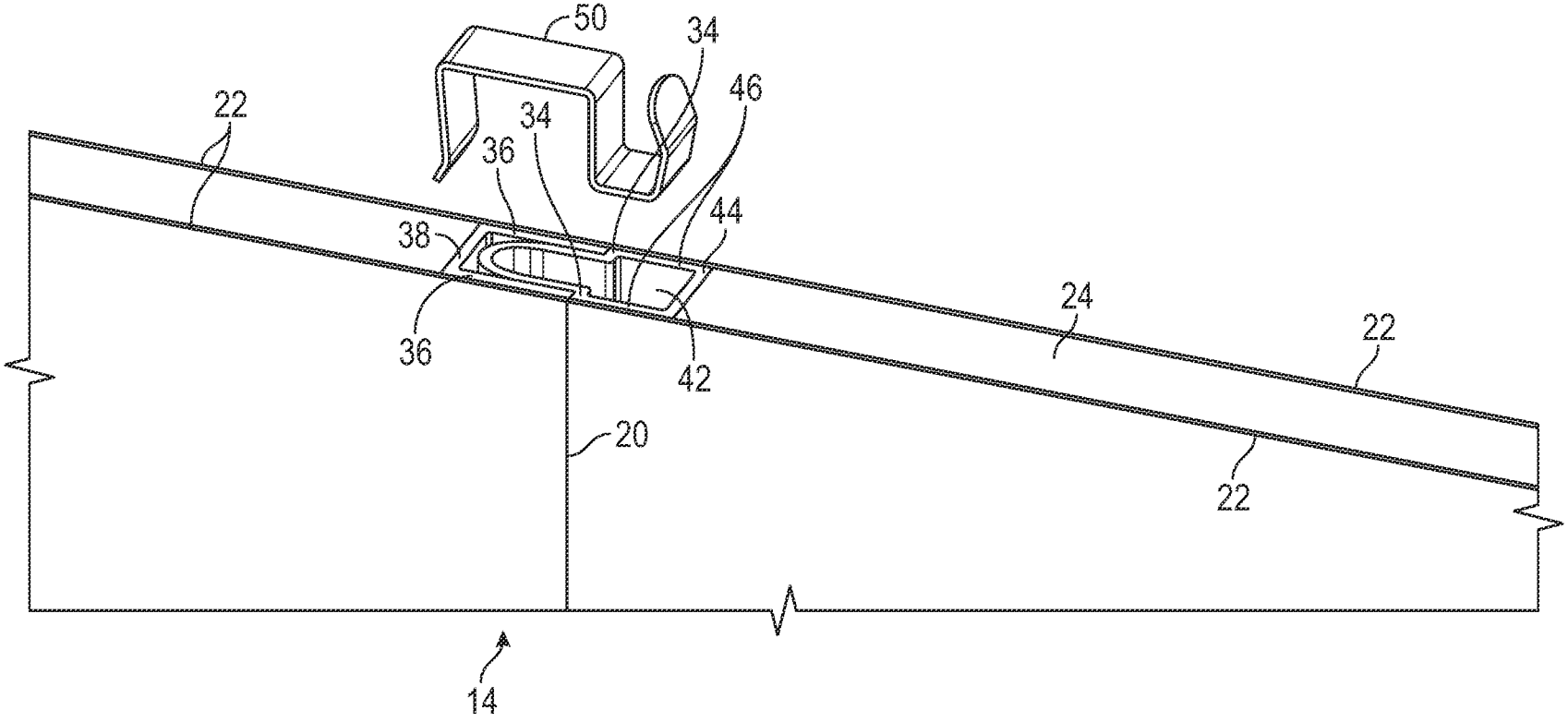
FIG. 2 Is a perspective view of wall panels with an inline clip prior to assembly.

Referring now to FIG. 2, two adjacent wall panels 12 are illustrated in an inline joint 14. In this example, the wall panels 12 have the two outer layers or skins 22 with a foam or core layer 24 therebetween. The outer layers or skins 22 may be planar and formed of acrylonitrile butadiene styrene (ABS) or another type of polymer, aluminum, paper or other materials. By forming the outer layer or skins 22 of plastic or aluminum, the outer layers or skins 48 become durable, washable and may be printed with graphics. The core layer 24 is a low-density material such as foam to make the walls lighter. Examples of the core layer 24 may include but are not limited to expanded polystyrene (EPS), isocyanurates, polyethylene and urethanes.

The wall panels 12 have joiners on the vertical edges thereof. A male joiner 30M has a shape that is received within a female joiner 30F. The female joiner 30F and the male joiner 30M may be formed of materials such as aluminum. In one example, the male joiner 30M and the female joiner 30F are formed from extruded aluminum. The female joiner 30F forms a rectangular C-shaped channel 32 that extends in the vertical direction when assembled. The male joiner 30M, in this example, has shoulders 34 that abut the sidewalls 36 of the female joiner 30F. The female joiner 30F may also have a lateral wall 38 extending between the sidewalls 36. The male joiner 30F has an extension 40 that extends from the shoulders 34 into the female joiner 30F between the sidewalls 36 and may not extend all the way to the lateral wall 38 when wall panels 12 are assembled.

The male joiner 30M forms a channel 42 that in enclosed between a lateral wall 44, side walls 46 extending longitudinally from lateral wall 44. The shoulders 34 extend inward from the side walls 46. The channel 42, in this example, also is defined by the extension 40 that extends from the shoulders 34. A wall (not illustrated) between the shoulders could also define the channel 42.

Figure 3:
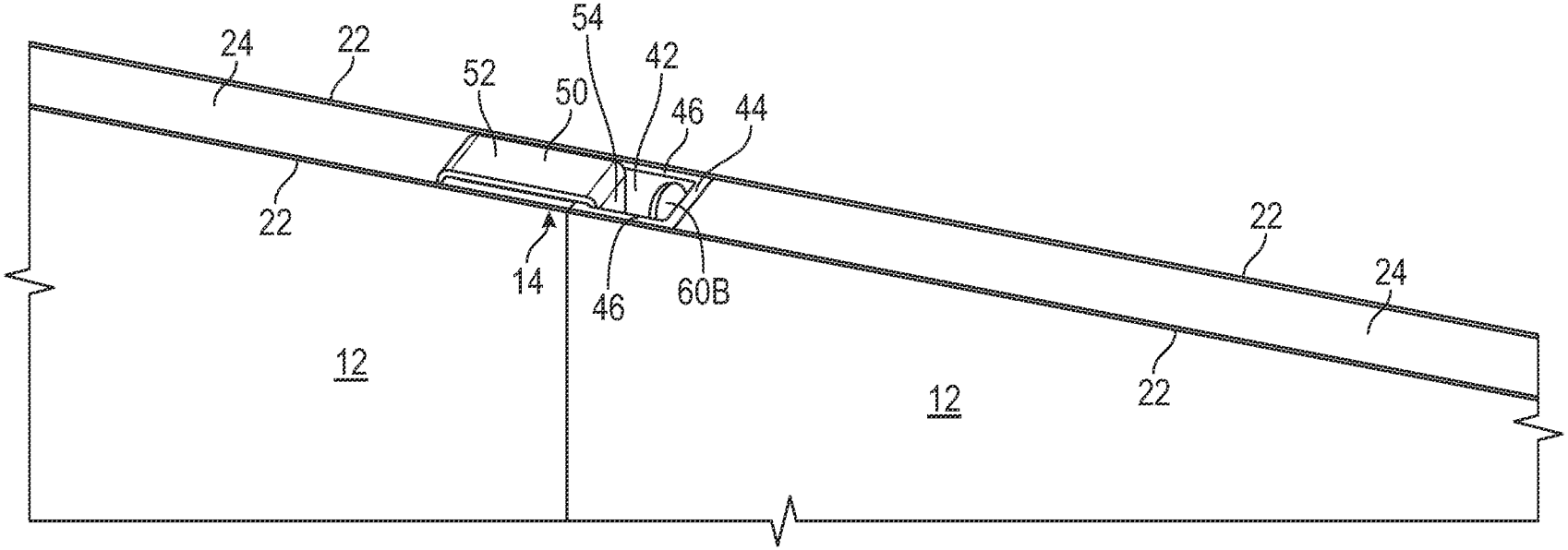
FIG. 3 Is a perspective view of wall panels with the inline clip after assembly.

Referring now to FIGS. 2, 3, 4A and 4B, a linear or inline clip 50 is illustrated in further detail. As illustrated in FIG. 3, the clip 50 is illustrated holding two wall panels 12 together at the inline joint 14 between the joiners 30F, 30M. The clip 50 may be formed of various materials including metal or plastic and has a spring characteristic.

The clip 50 has a longitudinal wall 52 having a first end 52A and a second end 52B. A vertical wall 54 has a first end 54A coupled to the first end 52A and a second end 54B. A recessed wall 56 has a first end 56A coupled to the second end 54B of the vertical wall 54. A second end 56B of the recessed wall 56 is coupled to a retaining wall 58. The vertical wall 54, the recessed wall 56 and the retaining wall 58 extend into the channel 42 within the male joiner 30M. The retaining wall 58 has a first retaining wall portion 58A extending from the second end 56B of the recessed wall 56 and a second retaining wall portion 58B coupled to the first retaining wall portion 58A. The intersection of the first retaining wall portion 58A and the second retaining wall portion 58B form a retaining edge 58C that extends against the lateral wall 44 of the male joiner 30M.

In this example, the vertical wall 54 is not necessarily 90° from the longitudinal wall 52. Although in this example, the longitudinal wall 52 is perpendicular to the vertical wall 54. The longitudinal wall 52 and the vertical wall 54 are joined by a curved wall in this example.

The recessed wall 56 is shorter than all the walls 52, 54, 56, 58 and 60. However, the second portions 58B and 60B are shorter than the recessed wall 56. The vertical wall 54 is longer than the retaining wall 56.

The recessed wall 56 extends perpendicular to the vertical wall 54 and is thus parallel to the longitudinal wall 52 in this example. Of course, the angles may be different. The recessed wall 56 is shorter than the vertical wall 54 and the longitudinal wall 52.

The first portion 58A of the retaining wall 58 extends in a direction toward a plane of the longitudinal wall 52 but at an angle more than 90° from the recessed wall 56. That is the first portion 58A is not parallel to the vertical wall 54 and extends away from the vertical wall 54. In this example, the angle A1 between the recessed wall 56 and the first portion is 100° s. The second portion 58B extends in a direction toward the vertical wall 54 in a direction less than 90° from the direction of the recessed wall 56. That is, should the second portion 56B and the vertical wall 54 be extended, they would intersect above the plane of the longitudinal wall 52. The angle between the first portion 58A and second portion 58B, in this example, is 160° s which is 50° relative to the vertical wall 54.

Figure 4A:
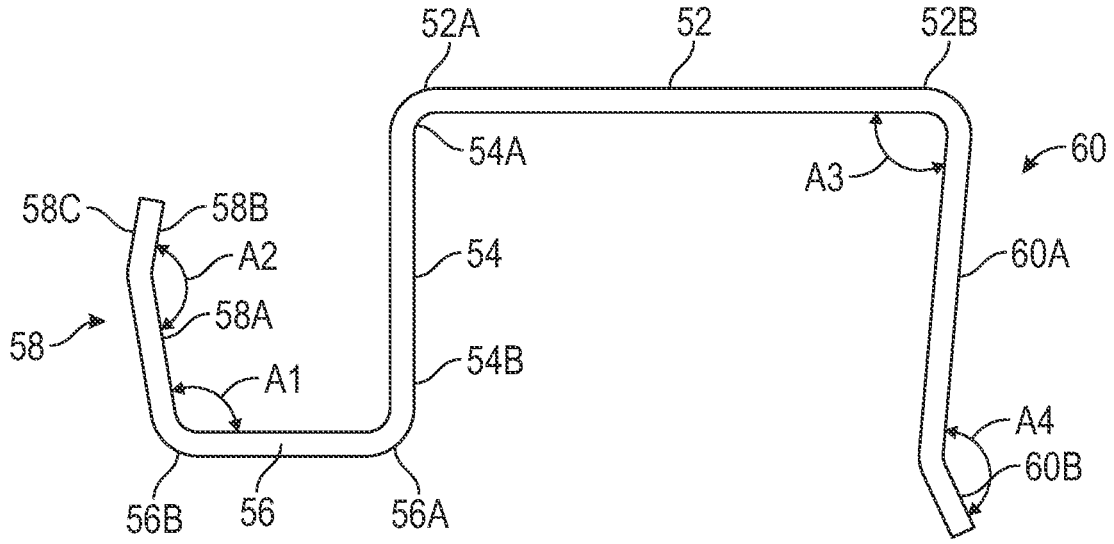
FIG. 4A is a side view of the clip of FIG. 1.
Figure 4B:
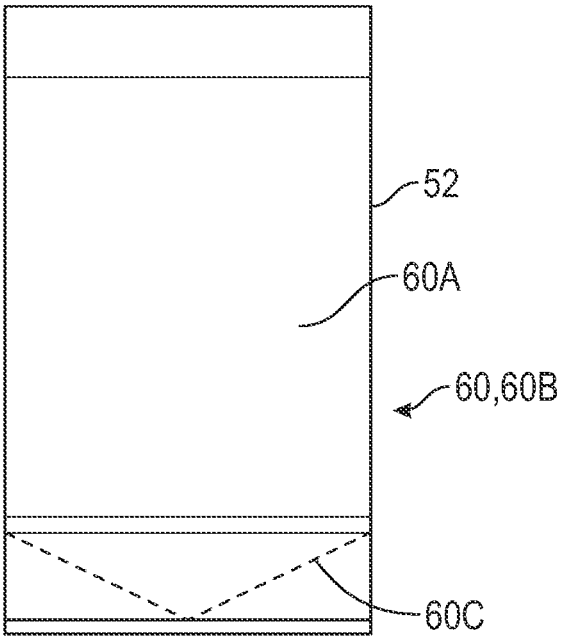
FIG. 4B is an end view of the clip of FIG. 1

An insert wall 60 has a first insert wall portion 60A and a second insert wall portion 60B. The first insert wall portion 60A extends from the longitudinal wall 52 at an opposite end and spaced apart from the vertical wall 54. The first insert wall portion 60A is disposed at an angle A3 85° from the longitudinal wall 52. A second insert wall portion 60B is disposed at an angle A4 (150° in this example) from the first insert wall portion 60A. The second insert wall portion 60B and the first insert wall portion 60A may be placed adjacent to a lateral wall 38 of the female joiner 30F but outside the female joiner 30F. In FIG. 4B, the lateral shape of the second insert wall portion 60B is straight or rectangular. However, as shown in hidden lines a tapered or pointed edge 60C may be used. The core layer 24 may be compressed adjacent to the top of the female joiner 40F to make room to accommodate the insert wall 60. In this manner, the first insert wall portion 60A and second insert wall portion 60B are retained at the female joiner 60F while the first retainer wall portion 58A, the second retainer wall portion 58B and the recessed wall 56 are disposed within the male joiner 30M. The forces exerted by the spring characteristic of the clip 50 prevent the female joiner 30F from being removed or disassembled from the male joiner 30M. In this manner, no tools are required to place or remove the clip 50 during the assembly process.

The insert wall 60 is longer than the vertical wall 54. The retaining wall 58 is shorter than the vertical wall 54 and insert wall 60. The vertical wall 54 is shorter than all the insert wall 60 and longer than the retaining wall 58.

The width of the clip 50 may be uniform and sized to be accommodated within the thickness of the wall panels 12 and more specifically with in the male joiner 40M between the two lateral walls 44.

Figure 5:
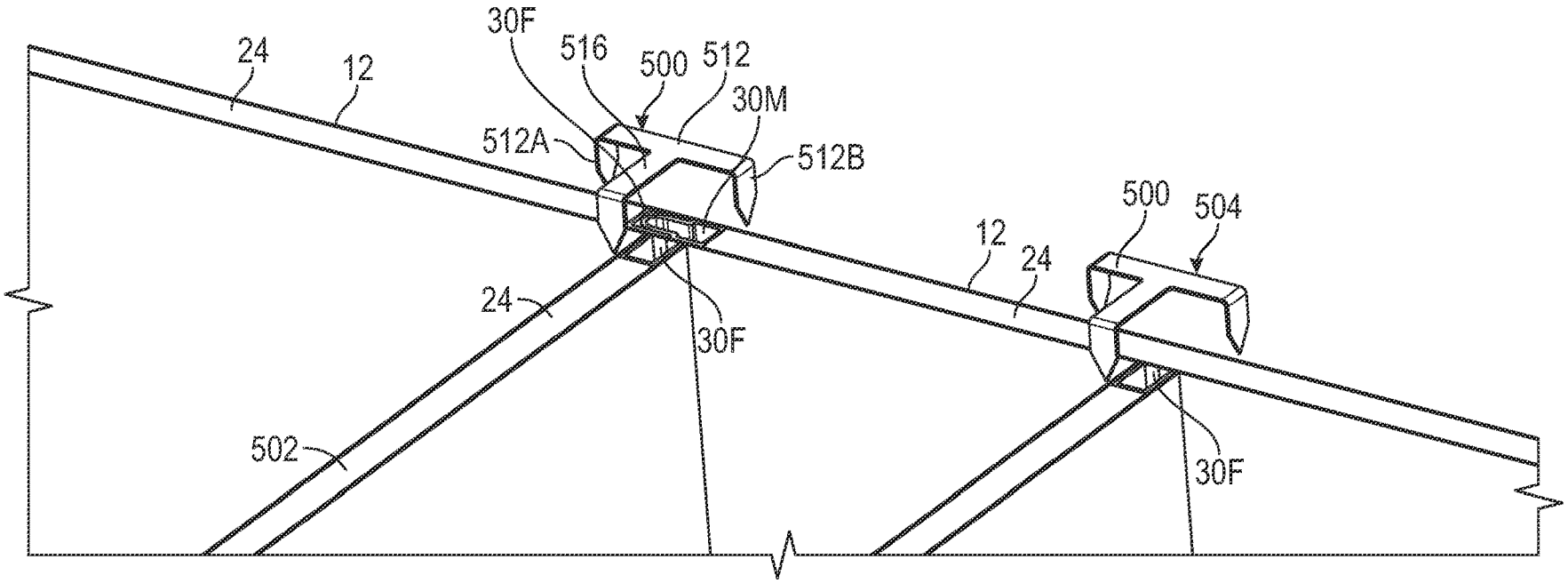
FIG. 5 Is a perspective view of wall panels with a T-clip prior to assembly.

Referring now to FIGS. 5-7C, a T-shaped clip or T-clip 500 is illustrated. The T-clip 500 is used for adjoining one or two inline wall panels 12 to a wall panel 502 disposed perpendicular to the or two inline panels 12. The T-clip 500 may be suitable for forming a joint at two walls that are joined at joiners 30F and 30M as described above. However, an alternate location 504 in the middle of one of the panels 12 not at the joiners 30F, 30M is possible. In FIG. 5, two panels 12 are linearly disposed while a third panel 502 is disposed perpendicular thereto. In this example, a female joiner 30F is disposed adjacent to the assembly of a female joiner 30F and a male joiner 30M. The female joiner 30F of the panel 502 could be a male joiner 30M as well.

The T-clip 500 is T-shaped with a first arm 510 and having a first vertical extension 512A and a second vertical extension 512B that extend into the core layer 24 at each of the wall panels 12. The first arm 510 of the T-clip 500 may be disposed near or directly adjacent to joiners 30F, 30M. That is, extension 512A and extension 512B are located at or near joiners 30F and 30M of panels 12, respectively. An arm 516 extends perpendicular from the first arm 510 and has extension 512A extending therefrom. The extension 512C is disposed near or directly adjacent to the female channel 30F of panel 502. However, as mentioned above, the T-clip 500 may be located at any place on a wall panel 12. Another location 504 is illustrated by the circle in FIG. 5.

The extensions 512A-C extend perpendicularly from their respective arms 510, 516. Further in this example, a radius 518 joins the extensions 512AA-C to their respective arms 510, 516. A radius 520 joins the arm 516 to the arm 510.

The extensions 512A-C are configured the same in this example and have a point 530. The points 530 are formed by sides 532 that are at an angle A5 from vertical. In this example the sides 532 are at (30°, in this example).

Figure 6:
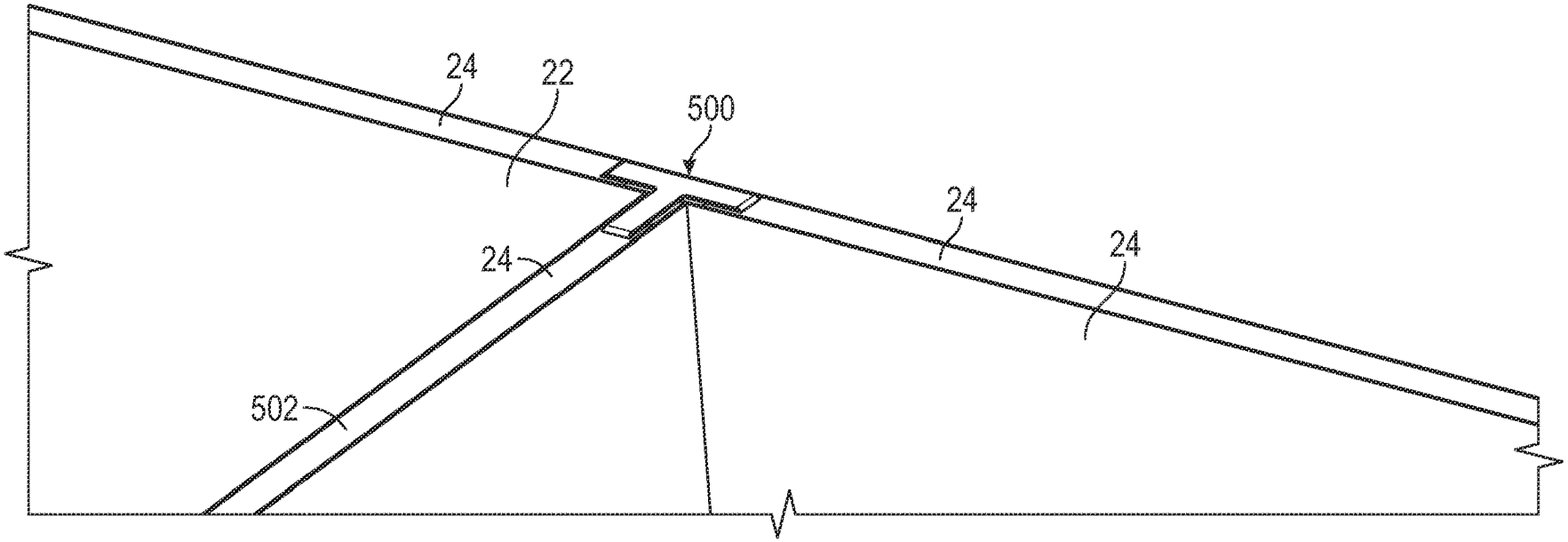
FIG. 6 Is a perspective view of wall panels with the T-clip after assembly.
Figure 7A:
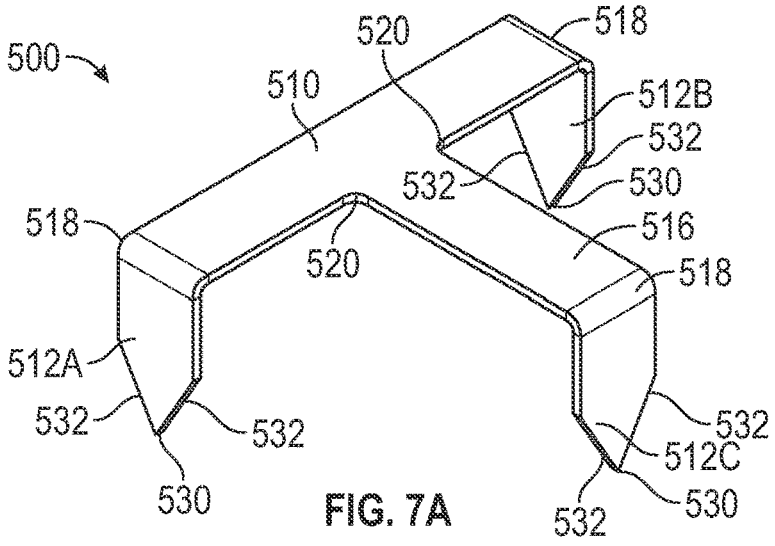
FIG. 7A is a perspective view of the T-clip.
Figure 7B:
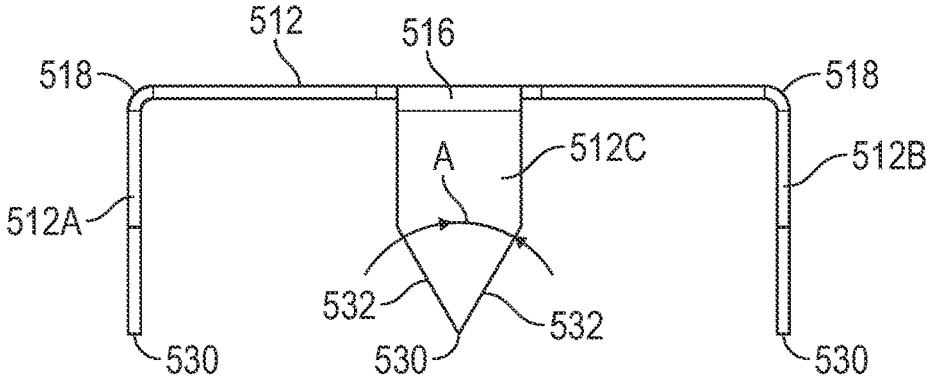
FIG. 7B is a side view of the T-clip.
Figure 7C:
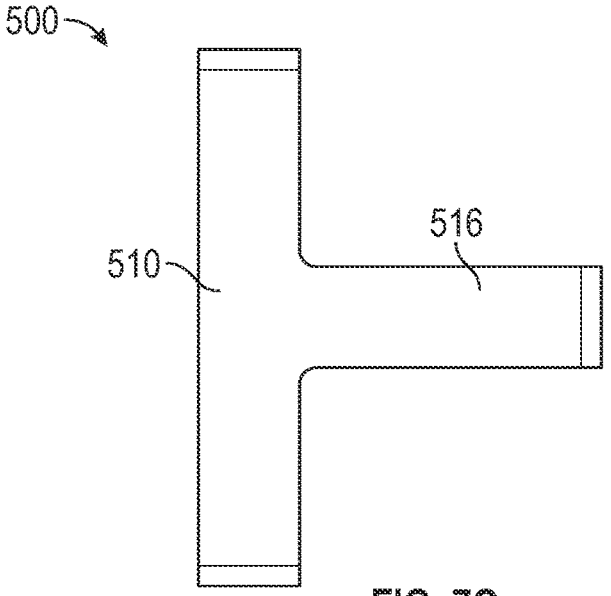
FIG. 7C is a top view of the T-clip.
Figure 8:
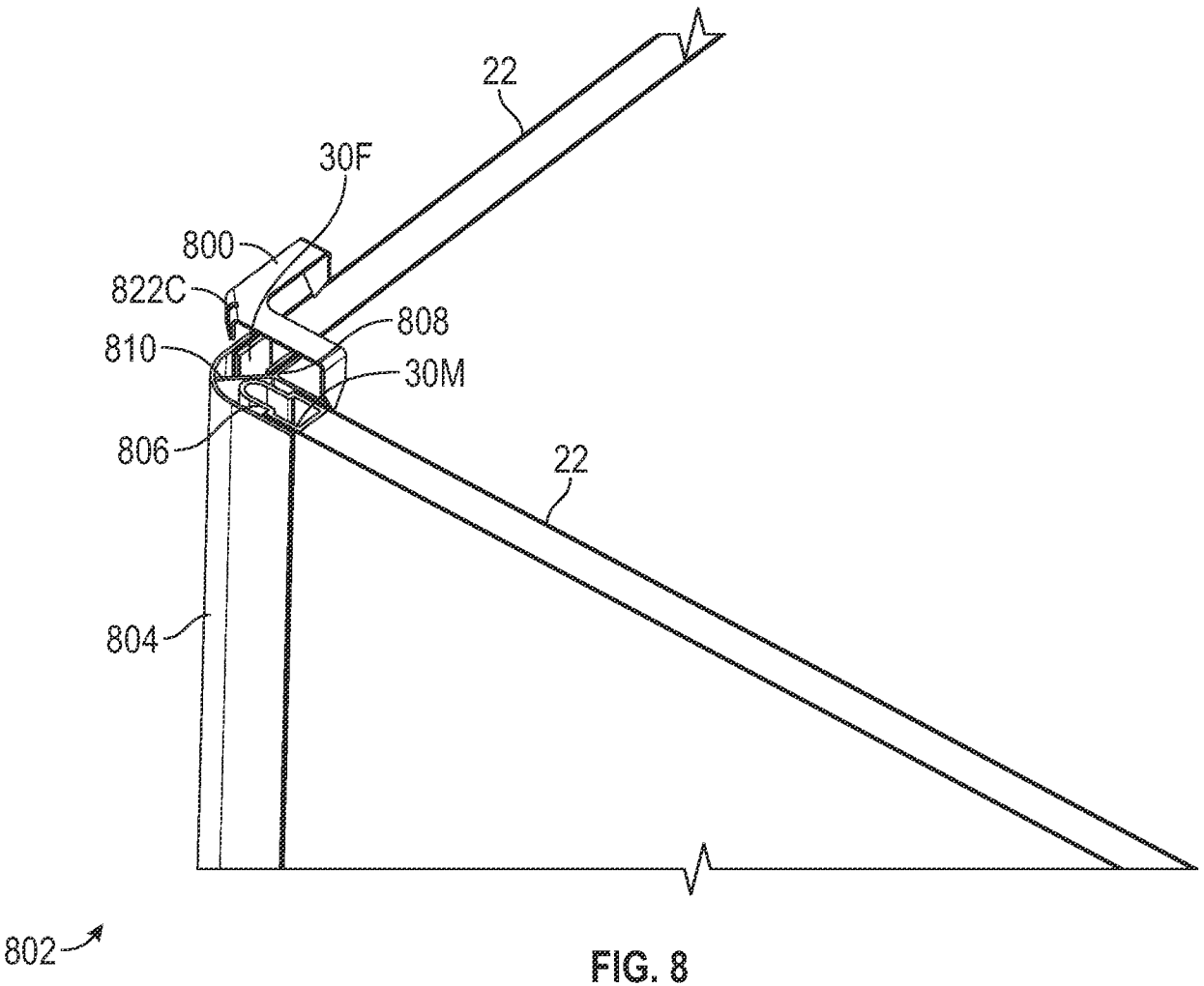
FIG. 8 Is a perspective view of wall panels with a corner clip prior to assembly.
Figure 9:
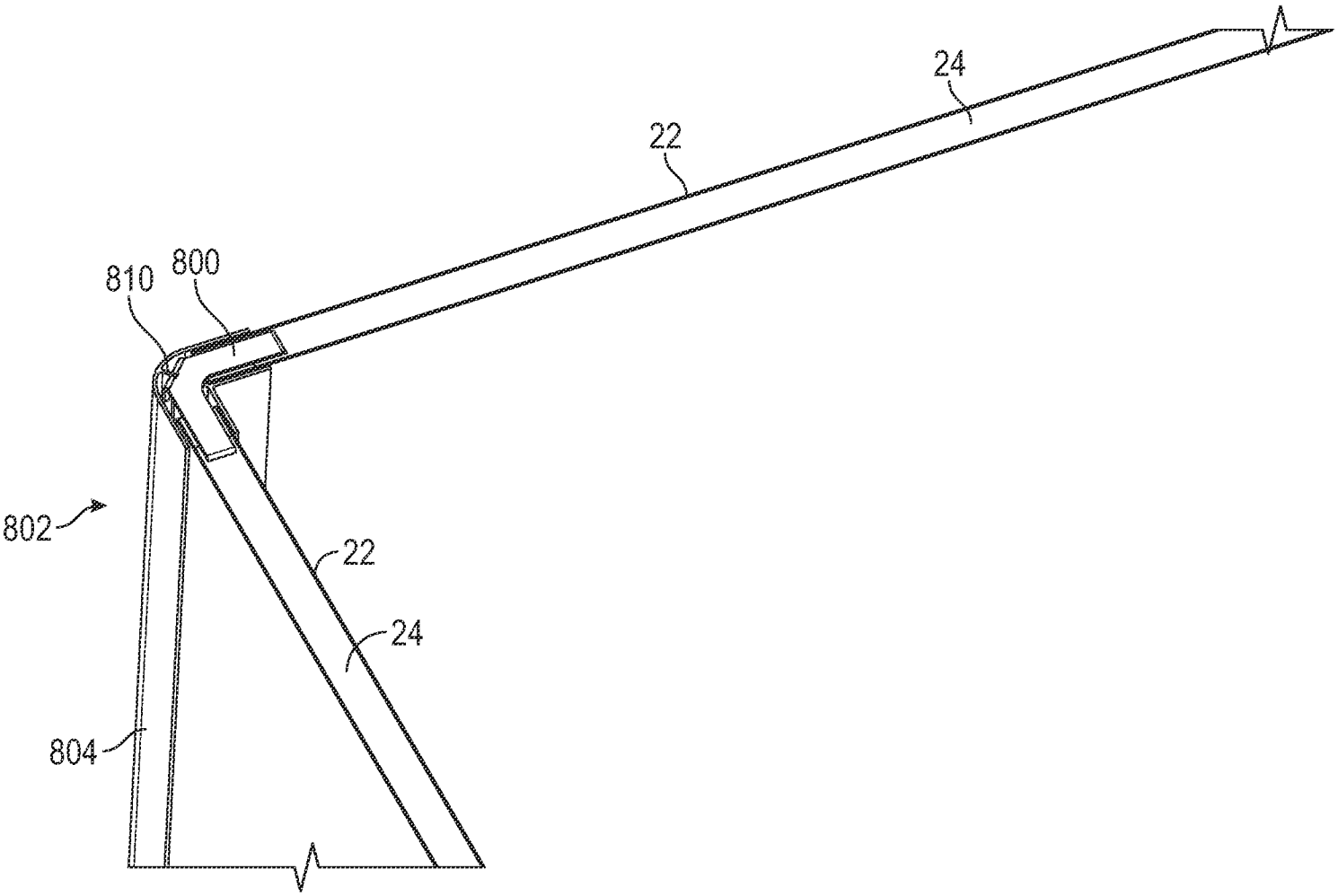
FIG. 9 Is a perspective view of wall panels with the corner clip after assembly.
Figure 10A:
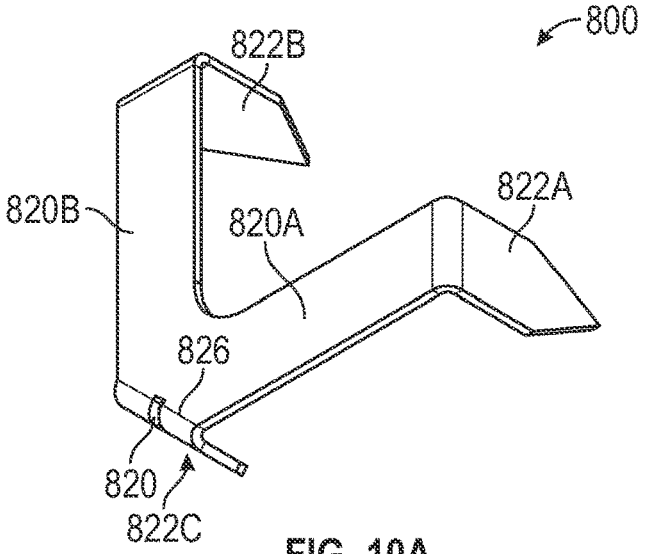
FIG. 10A is a perspective view of the corner clip.
Figure 10B:
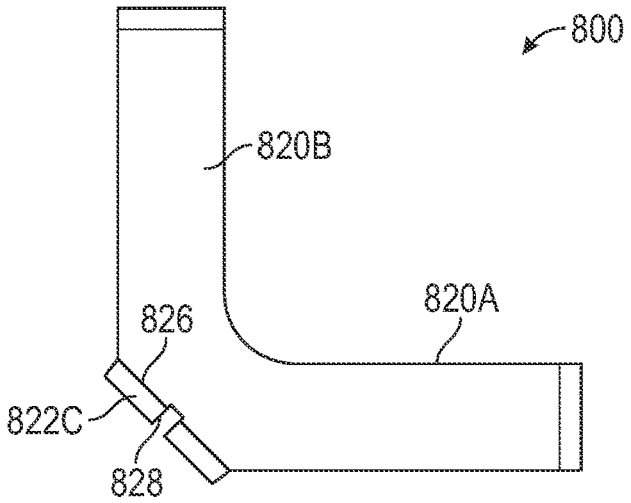
FIG. 10B is a top view of the corner clip.
Figure 10C:
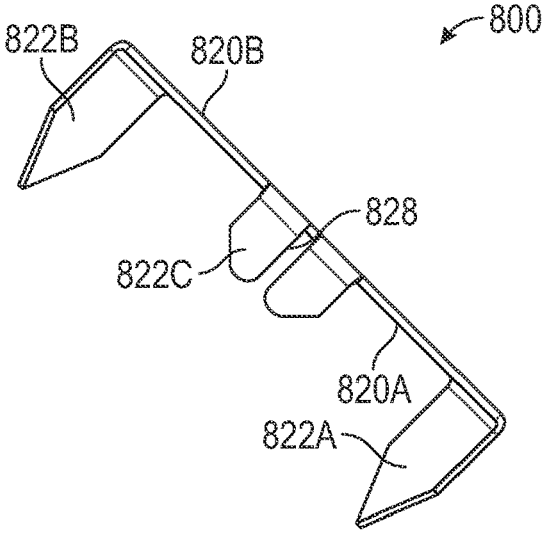
FIG. 10C is an end view of the corner clip from a corner of the clip.

In FIG. 6 specifically, the T-clip 500 is shown in the assembled position. The extensions 512A-C and the points 530 thereon extend into the wall material such as the core layer 24. During assembly, the two wall panels 12 or one wall panel is positioned as part of a wall system. The panel 502 is held in position and the T-clip 500 is pushed into the top of the panels 12, 501, which may be adjacent to or near joiners 30F, 30M.

Referring now to FIGS. 8-10C, a corner clip 800 is illustrated in further detail. A corner 802 happens when two adjacent wall panels 12 are placed at 90° relative to each other, although other angles are possible. The corner clip 800 is illustrated for a 90° corner. The two adjacent panels 12 have a respective male joiner 30M and a female joiner 30F that are positioned by a corner coupler 804. In this example the coupler has a rounded outer edge. The male joiner 30M is received in a receiver 806 of the corner coupler 804. A coupler 808 engages the female coupler 30F of the wall panel 12. In this example, the coupler 808 is a receiver. However, a male extension may be inserted into the female joiner 30F in an alternate design. The coupler 804 in this example has an elongated wall 810 extending in a vertical direction that separate the female side from the male side. The elongated wall 810 is at a 45° angle to the direction of both panels 12.

In this example, the corner clip 500 has a first arm 820A and a second arm 820B that are disposed at a 90° angle to each other, in this example. Arm 820A has a first extension 822A and arm 820B has a second extension 822B that are placed adjacent to or near a male joiner 30M and a female joiner 30F respectively on two adjacent wall panels 12. A third extension 822C extends from an edge 826 disposed at a 45° angle between the arm 820A and 820B on the outside relative to the corner 802 and is used to receive the wall 810 of the corner coupler 804. The elongated wall 810 is received within a groove 828 of the third extension 822C. Thus, the forces applied by the corner coupler 804 and the first extension 822A, the second extension 822B and the third extension 822C maintain the position of the first wall panel 12, the second wall panel 12 and the corner coupler 804 relative to each other.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90° or at other orientations) and the spatially relative descriptors used herein interpreted accordingly.

What is claimed is:

1. A clip for coupling a first wall panel comprising a first joiner having a first channel, and said first wall having a core adjacent to the first joiner and a second wall panel comprising a second joiner having a second channel, said clip comprising:

a longitudinal wall;

a vertical wall perpendicular coupled to the longitudinal wall;

a recessed wall coupled to the vertical wall;

a retaining wall coupled to the recessed wall extending from the recessed wall in a direction toward a plane of the longitudinal wall;

said vertical wall, the recessed wall and said retaining wall extending into the second channel formed by the second joiner; and an insert wall extending from the longitudinal wall and sized to be received outside the first channel, the longitudinal wall, the vertical wall, the recessed wall, the retaining wall and the insert wall are sized so that the insert wall is adjacent to a lateral wall of the first joiner and outside the first channel when the vertical wall, the recessed wall and the retaining wall extend into the second channel formed by the second joiner.

2. The clip of claim 1 wherein the insert wall comprises a first insert wall portion extending from the longitudinal wall spaced apart from the vertical wall and second insert wall portion extending from the first insert wall portion.

3. The clip of claim 2 wherein the first insert wall portion is disposed at a first angle relative to the longitudinal wall and the second insert wall portion is at a second angle relative to the longitudinal wall, said first angle different than the second angle.

4. The clip of claim 1 wherein the longitudinal wall has a first end and a second end, said vertical wall extending from the first end and the insert wall extending from the second end.

5. The clip of claim 1 wherein the retaining wall comprises a first retaining wall portion coupled to the recessed wall and a second retaining wall portion coupled to the first retaining wall.

6. The clip of claim 5 wherein the first retaining wall portion is disposed at a first angle relative to the recessed wall and the second retaining wall portion is disposed at a second angle relative to the recessed wall different than the first angle.

7. The clip of claim 1 further comprising a retaining edge at an intersection of the first retaining wall portion and the second retaining wall portion, said retaining edge extending against a lateral wall of the second joiner.

8. The clip of claim 1 wherein the recessed wall extends longitudinally from the vertical wall.

9. The clip of claim 1 wherein the recessed wall extends longitudinally from the vertical wall and parallel to the longitudinal wall.

10. The clip of claim 1 wherein the vertical wall is longer than the retaining wall.

11. The clip of claim 1 wherein the insert wall is longer than the vertical wall.

12. The clip of claim 1 wherein the retaining wall is shorter than the vertical wall and insert wall.

13. The clip of claim 1 wherein a first insert wall portion of the insert wall is disposed at a first angle relative to the longitudinal wall.

14. The clip of claim 13 wherein the first angle is about 85 degrees.

15. The clip of claim 13 wherein a second insert wall portion of the first insert wall portion is disposed at a second angle relative to the longitudinal wall, said first angle different than the second angle.

16. A wall system comprising:

a clip having, a longitudinal wall;

a vertical wall perpendicular coupled to the longitudinal wall;

a recessed wall coupled to the vertical wall;

a retaining wall coupled to the recessed wall extending from the recessed wall;

said vertical wall, the recessed wall and said retaining wall extending into a channel formed by the second joiner; and an insert wall extending from the longitudinal wall and sized to be received outside the first channel;

the first wall panel comprising the first joiner;

the second wall panel comprising the second joiner; and wherein the vertical wall, the recessed wall and the retaining wall are received in the first channel and wherein the first joiner is a female joiner and the second joiner is a male joiner.

17. The wall system of claim 16 wherein a second portion of the insert wall extends from the channel when the clip is assembled.

18. The wall system of claim 16 wherein the insert wall is near the first joiner when assembled.

19. The wall system of claim 16 wherein the insert wall is directly adjacent to the first joiner when assembled.

* * * * *